US009493329B2

(12) United States Patent
Lemke

(10) Patent No.: US 9,493,329 B2
(45) Date of Patent: Nov. 15, 2016

(54) HYDRAULIC APPARATUS

(75) Inventor: Frank Lemke, Moosburg (DE)

(73) Assignee: JUNGHEINRICH AKTIENGESELLSCHAFT, Hamburg (DE)

( * ) Notice: Subject to any disclaimer, the term of this patent is extended or adjusted under 35 U.S.C. 154(b) by 707 days.

(21) Appl. No.: 13/316,739

(22) Filed: Dec. 12, 2011

(65) Prior Publication Data

US 2012/0145486 A1 Jun. 14, 2012

(30) Foreign Application Priority Data

Dec. 13, 2010 (DE) ..... 10 2010 062 936

(51) Int. Cl.
*B66F 9/22* (2006.01)
*F15B 13/08* (2006.01)

(52) U.S. Cl.
CPC ..... *B66F 9/22* (2013.01); *F15B 13/0892* (2013.01)

(58) Field of Classification Search
CPC ..... B60K 25/00; B66F 9/22; F04B 17/03; F04B 35/04; F15B 13/0832; F15B 13/0878; F15B 13/0885; F15B 13/0892
USPC ..... 180/53.4; 187/233; 417/410.1
See application file for complete search history.

(56) References Cited

U.S. PATENT DOCUMENTS 3,079,750 A * 3/1963 Leach ..... 60/426
3,086,618 A * 4/1963 Christiansen ..... 187/222
3,179,020 A * 4/1965 Rumsey et al. ..... 92/125
3,400,953 A * 9/1968 Sullivan ..... 285/50
4,123,201 A * 10/1978 Andriulis ..... 417/204
4,824,334 A * 4/1989 Ramsay ..... 417/360
4,929,038 A 5/1990 Reinartz et al.
6,431,845 B1 * 8/2002 Thomas et al. ..... 417/571
6,491,505 B1 * 12/2002 Hueser et al. ..... 417/410.3
7,185,742 B2 * 3/2007 Langen ..... 187/224
7,354,511 B2 4/2008 Becker
2006/0228235 A1 * 10/2006 Neumair et al. ..... 417/410.1
2007/0261741 A1 11/2007 Hellmann
2011/0129367 A1 * 6/2011 Han et al. ..... 417/410.1
2011/0200465 A1 * 8/2011 Cho et al. ..... 417/410.1
2013/0251558 A1 * 9/2013 Neumair ..... 417/410.1

FOREIGN PATENT DOCUMENTS

DE 3729216 A1 3/1989
DE 42 19 462 A1 12/1993
(Continued)

OTHER PUBLICATIONS

Machine translation of DE 19959022 C1.*

*Primary Examiner* — Barry Gooden, Jr.
(74) *Attorney, Agent, or Firm* — Rothwell, Figg, Ernst & Manbeck PC

(57) ABSTRACT

The invention relates to a hydraulic apparatus comprising a hydraulic pump (30) which is connectable to a hydraulic fluid tank, an electric motor (2) as a drive means for the hydraulic pump (30), which electric motor comprises a motor shaft and a motor housing cover (4), and a control valve assembly (12) connected to the pump (30) to control at least one hydraulic consumer which is connectable to the pump (30) and is to be supplied by the pump (30) with hydraulic fluid from the hydraulic fluid tank, wherein the pump (30) is fixed on the motor housing cover (4) and the motor housing cover (4) comprises a holding adapter (10) on which the control valve assembly (12) is fixed.

13 Claims, 3 Drawing Sheets

(56) References Cited

FOREIGN PATENT DOCUMENTS

| | | | |
|---|---|---|---|
| DE | 44 16 173 | C2 | 5/1996 |
| DE | 197 25 092 | A1 | 12/1998 |
| DE | 197 25 093 | A1 | 12/1998 |
| DE | 197 39 233 | A1 | 3/1999 |
| DE | 199 59 022 | C1 | 6/2001 |
| JP | 2007138174 | A | 6/2007 |

* cited by examiner

HYDRAULIC APPARATUS

The invention relates to a hydraulic apparatus, in particular a hydraulic apparatus for an industrial truck, comprising a hydraulic pump which is connectable to a hydraulic fluid tank, an electric motor as a drive means for the hydraulic pump, which electric motor comprises a motor shaft and a motor housing cover, and a control valve assembly connected to the pump for controlling at least one hydraulic consumer which is connectable to the pump and is to be supplied by the pump with hydraulic fluid from the hydraulic fluid tank.

Hydraulic apparatuses of the aforementioned type are used for example in industrial trucks having hydraulically controllable lifting devices.

The object of the present invention is to provide such a hydraulic apparatus which can be installed in a simple manner in an environment of hydraulic components for the hydraulic supply and control thereof, is easily maintained, compact and cost-effective.

In order to achieve this object, it is proposed in accordance with the invention that the pump is fixed to the motor housing cover and that the motor housing cover comprises a holding adapter to which the control valve assembly is fixed.

The underlying idea of the invention was to construct a hydraulic apparatus based on an inexpensive standard electric motor, wherein the further functional components, namely the pump and the control valve assembly, are to be arranged on an interchangeable motor housing cover which comprises holding and fixing means for this purpose. This motor housing cover is preferably a drive-end shield. This is normally understood to mean the motor housing cover on the drive side of the motor, wherein such a drive-end shield generally comprises a fixed bearing for the motor shaft. The drive-end shield prepared for the purpose of the present invention is preferably easily interchangeable with a standard drive-end shield of a standard electric motor and is equipped with corresponding connector-compatible fixing means. A very simple and cost-effective solution to provide a compact and, on the whole, inexpensive hydraulic apparatus is thus provided in accordance with the invention.

In accordance with a preferred embodiment of the invention the holding adapter for the control valve assembly is arranged transversely in relation to the motor shaft axis, and in particular protrudes radially outwardly from the motor housing cover. The holding adapter thus formed comprises on its protruding end a console on which the control valve assembly is received in a fixed manner.

The holding adapter thus formed as a spacer between the motor housing and the control valve assembly ensures a cooling air flow over the motor housing and the control valve assembly sufficient for trouble-free operation and also enables a rather compact construction of the hydraulic apparatus, wherein the control valve assembly is preferably a modular unit assembled to form a control valve block.

In accordance with a development of the invention, the valve block and the holding adapter are formed with complementary assembly aid stop faces which make it easier to arrange the valve block, during assembly, in its correct position on the holding adapter so that it can then be fixed to the holding adapter using conventional fixing means, for example screws.

A hydraulic fluid filter is preferably also fixed on the valve block in an interchangeable manner and is connected to the pump via a hydraulic fluid line. The pump is fixed on the end face of the motor on the specialised motor housing cover, that is to say preferably on the replacement drive-end shield and is coupled to the motor shaft so that the pump can be operated in a rotary manner by the electric motor. The longitudinal direction of the motor corresponds to the orientation of the motor shaft axis, and the length of the hydraulic apparatus along this longitudinal axis is basically determined by the motor housing and the pump placed thereon. The valve block on the holding adapter preferably extends basically parallel to this longitudinal direction, more specifically so that it basically does not protrude outwardly beyond the motor housing and the pump in the longitudinal direction (even if a hydraulic fluid filter is included). The purpose of this measure is also to form the hydraulic apparatus in a compact manner on the whole.

The control valve assembly and the pump are preferably fixed to the motor cover in a detachable and therefore interchangeable manner, wherein the pump and the control valve assembly are separable from one another. The interchangeability of the individual hydraulic components is thus ensured, which simplifies maintenance and repair of the hydraulic apparatus where necessary.

The invention also relates to a drive-end shield for an electric motor, wherein the drive-end shield comprises a holding adapter which is adapted to receive a control valve block in a predefined orientation, and also comprises fixing means for fixing a pump on the end face of the drive-end shield.

This drive-end shield is formed in such a way that it can be interchanged with a standard bearing shield of an electric motor so as to create a hydraulic apparatus based on such an electric motor in a simple manner.

The invention further relates to an industrial truck having a lifting device which comprises a lifting frame having a load suspension means movable thereon to different heights, and which can be controlled hydraulically so as to raise and lower the load suspension means on the lifting frame, wherein the industrial truck is characterised by a hydraulic apparatus according to the present invention which is designed to hydraulically supply and control the lifting device and optionally further hydraulic consumers.

The industrial truck preferably has a hydraulic steering device, wherein the hydraulic apparatus is designed to also control the hydraulic steering device hydraulically.

An embodiment of the invention will be described hereinafter in greater detail with reference to the figures, in which.

Figure 1:
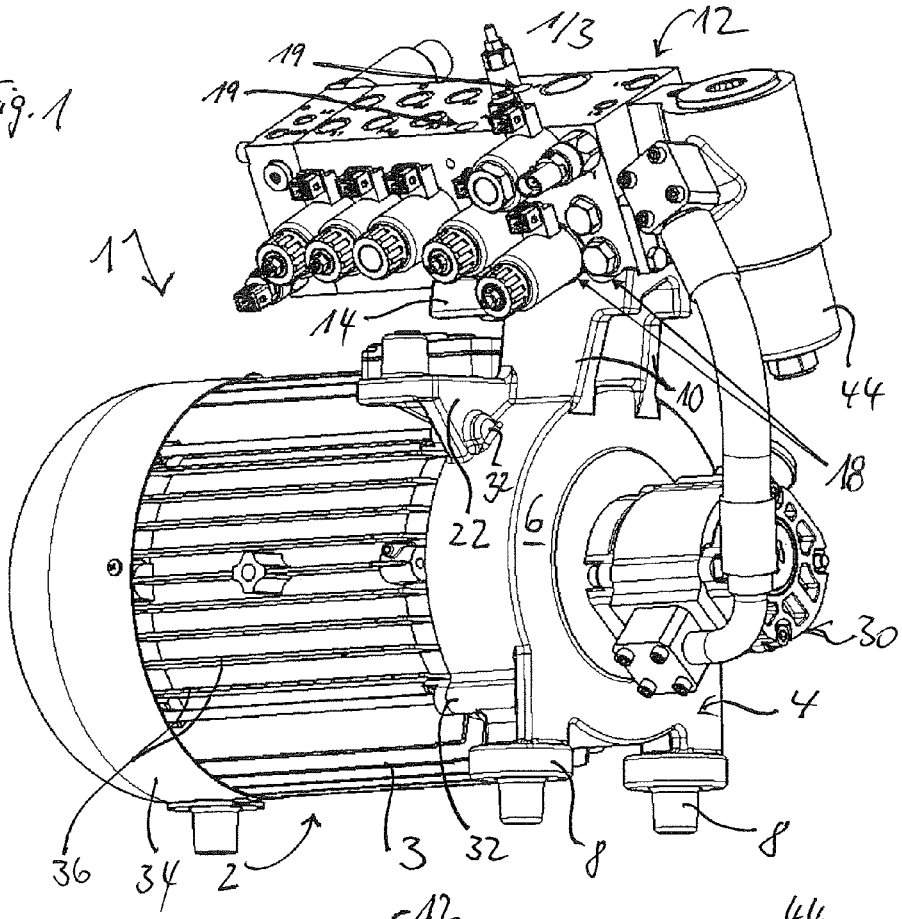
FIG. 1 is a perspective view of the hydraulic apparatus of the invention, viewed at an angle towards the drive-side end of the electric motor.

The hydraulic apparatus 1 according to FIG. 1 comprises an electric motor 2, which is a modified standard electric motor, wherein the modification consists in the fact that the original drive-side motor housing cover has been replaced by a modified motor housing cover 4. The housing cover 4 is a drive-end shield which is illustrated in an isolated manner in FIG. 4. It comprises a cover cap 6, on which lower fixing means 8 are provided for fixing the hydraulic apparatus 1 to a frame (see 70 in FIG. 6). On the opposite upper side, the drive-end shield 4 comprises a holding adapter 10 on its cover cap 6 for fixing a control valve block 12. The holding adapter 10 protrudes radially outwardly from the drive-end shield 4 and from the cover cap 6 thereof in relation to the central longitudinal axis X and comprises a console 14 on its protruding end. The console 14 has stop faces 16 and apertures 18, these being assembly aid stop elements, which are to be brought into engagement with corresponding complementary elements of the control valve block 12 (see 18 in FIG. 1). The console further comprises threaded holes 20 for fixing the control valve block 12, which in turn comprises holes 19 for passing through fixing screws. A torque support 22 is provided on the drive-end shield 4 in the peripheral direction of the cover cap 6 offset from the holding adapter 10 and constitutes a further fixing means. On the end face, the drive-end shield comprises a central opening 24 for passing through of the motor shaft. A journal bearing 26 is also provided at this opening. The threaded holes 28 are fixing points for fixing a pump 30 in the position shown in FIGS. 1 to 3 on the end face of the drive-end shield 4.

Figure 4:
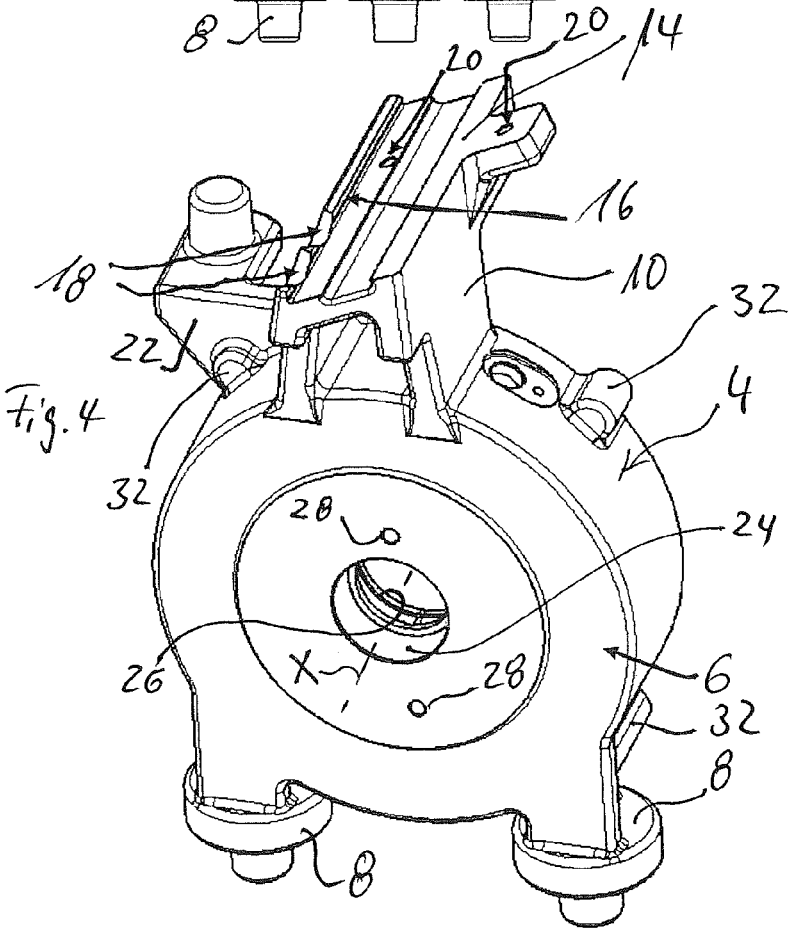
FIG. 4 is a perspective view of the drive-end shield with no further components.

According to FIG. 4, the drive-end shield 4 also comprises fixing points 32 for its fixing to the other motor housing 3 of the electric motor 2.

Figure 2:
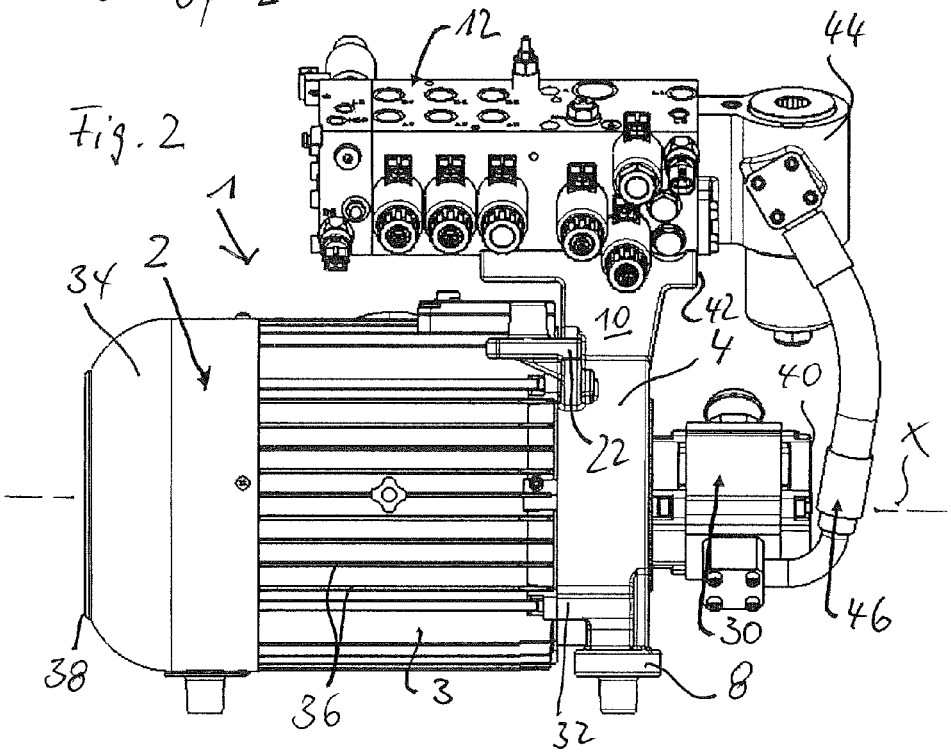
FIG. 2 is a side view of the hydraulic apparatus from FIG. 1.

As can be seen in particular from FIGS. 1 and 2, the electric motor has a roughly outlined cylindrical motor housing 3 which is terminated in the longitudinal direction by a rear non-drive-end shield 34 at one end and also by the drive-end shield 4, which has already been discussed, at the other end. Cooling ribs 36 are provided in the central part of the longitudinal side of the housing 3.

Figure 3:
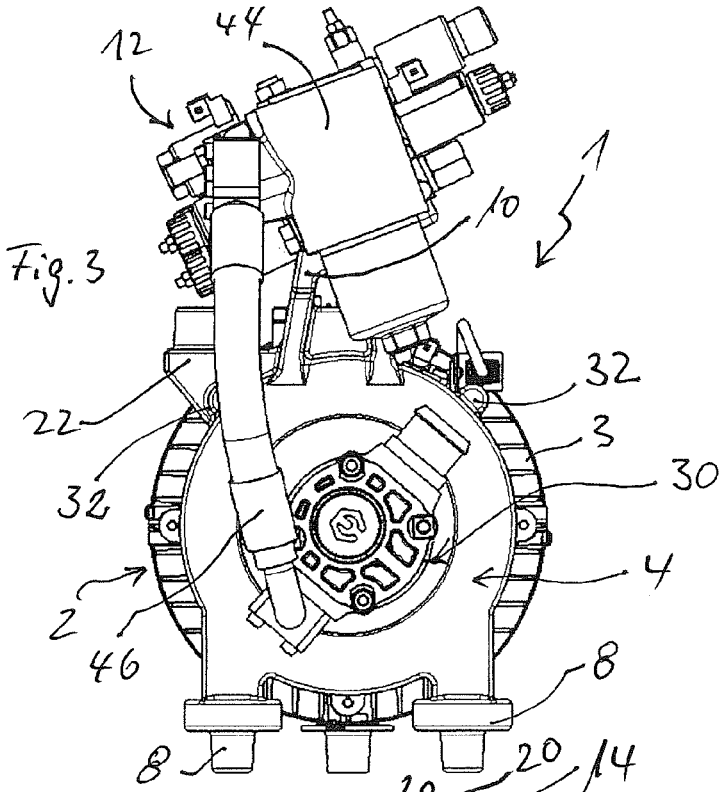
FIG. 3 is a front view of the hydraulic apparatus on the drive-side of the electric motor.

In FIGS. 1 to 3 the control valve block 12 is fixed and positioned on the console 14 of the holding adapter 10 in such a way that it extends basically parallel to the longitudinal axis X without protruding significantly beyond the rear end 38 of the motor 2 and beyond the front end 40 of the pump in the longitudinal direction.

The valve block 12 can be controlled by means of an electric control device so as to control the hydraulic flow to and from hydraulic consumers which are to be connected to the valve block 12. A hydraulic fluid filter 44 is provided at the pump-side end 42 of the valve block 12 and is connected via a hydraulic line 46 (pressure line) to the pressure side of the pump 30 so that hydraulic fluid fed from the pump flows through the filter 44 before the entry into the control valve block 12, where it is then filtered.

The control valve assembly 12, 44, pump 30 and pressure line 46 components are installed so as to be individually interchangeable, which considerably simplifies maintenance and servicing. The filter 44 may also easily be separated from the control valve block 12 as required.

As can be seen in FIGS. 1 to 3, the hydraulic apparatus 1 according to the invention is a compact modular unit, wherein the holding adapter 10 holds the control valve assembly formed of the control valve block 12 and filter 44 so as to be distanced radially from the electric motor 2 to such an extent that a cooling air flow can pass through therebetween.

Figure 5:
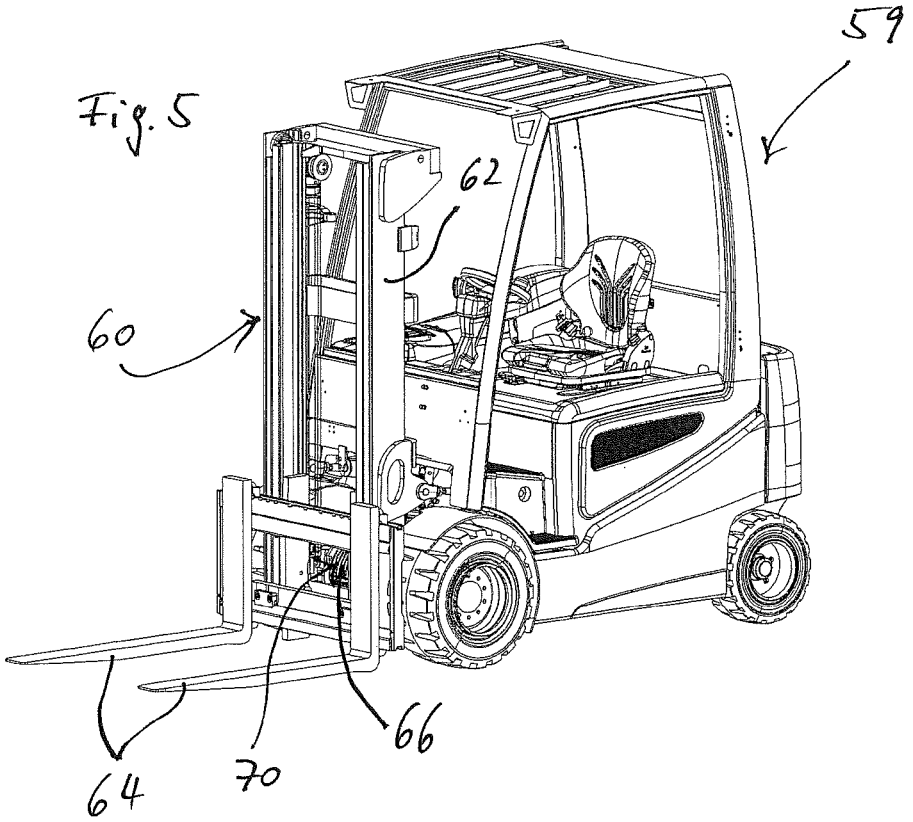
FIG. 5 is a perspective view of an industrial truck according to the invention which contains a hydraulic apparatus according to FIGS. 1 to 3.
Figure 6:
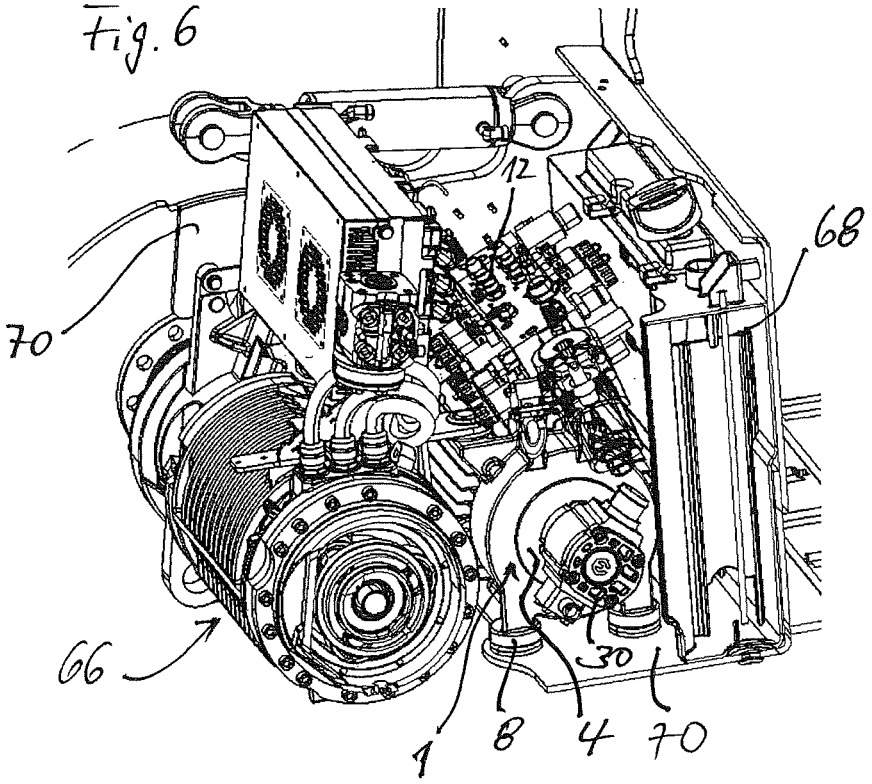
FIG. 6 is a partial cut-out view of the front frame of the industrial truck from FIG. 5 with incorporated working apparatuses, inter alia also with the hydraulic apparatus according to the invention.

The hydraulic apparatus 1 according to the invention, which can be formed in a relatively cost-effective manner, is easy to maintain and compact, may be incorporated for example in an industrial truck according to FIG. 5, as can be seen in greater detail in FIG. 6, so as to supply different hydraulic consumers.

The industrial truck according to FIG. 5 is an electric fork lift truck having a hydraulic lifting device 60. The lifting device 60 comprises a lifting frame 62, on which load-bearing forks 64 can be raised and lowered by means of hydraulic lifting cylinders so as to receive and transport loads. A hydraulic apparatus 1, as is shown in FIGS. 1 to 3, is provided for the hydraulic supply and control of the hydraulic lifting cylinders. The hydraulic apparatus 1 is illustrated in FIG. 6 in its installed position between a driving front axle 66 of the industrial truck and a hydraulic tank 68 in the front frame region 70 of the industrial truck 59. Owing to its compact design, the hydraulic apparatus 1 according to the invention makes it possible to mount the further components 66, 68 in the front frame region 70 in a space-saving manner. In the partial sectional view according to FIG. 6 the connection line between the pump and the filter of the hydraulic apparatus 1 is not shown. The filter can be seen in a cut-out view in FIG. 6.

The invention claimed is:

1. A hydraulic apparatus comprising:

a hydraulic pump that is connectable to a hydraulic fluid tank;

an electric motor for driving the hydraulic pump, the electric motor including:

a motor shaft; and a motor housing cover; and a control valve assembly connected to the hydraulic pump for controlling at least one hydraulic consumer, when the at least one hydraulic consumer is connected to the hydraulic pump through the control valve assembly and supplied by the hydraulic pump with hydraulic fluid from the hydraulic fluid tank, wherein the hydraulic pump is directly fixed on the motor housing cover, and wherein the motor housing cover includes a holding adapter on which the control valve assembly is fixed, wherein the hydraulic pump is hydraulically connected to the control valve assembly by a hydraulic fluid line external to the motor housing cover and the hydraulic pump, wherein the control valve assembly and the pump are each individually detachably and interchangeably fixed to the motor cover and wherein the hydraulic fluid line is detachably and interchangeably fixed to each of the hydraulic pump and the control valve assembly, and wherein the pump, the control valve assembly and the hydraulic fluid line are separable from one another.

2. The hydraulic apparatus according to claim 1, wherein the motor housing cover serves as a drive-end shield of the electric motor.

3. The hydraulic apparatus according to claim 1, wherein the holding adapter protrudes transversely in relation to the motor shaft and comprises on a protruding end a console on which the control valve assembly is received.

4. The hydraulic apparatus according to claim 3, wherein the holding adapter protrudes radially outwardly from the motor housing cover.

5. The hydraulic apparatus according to claim 1, wherein the control valve assembly is a modular unit assembled to form a control valve block.

6. The hydraulic apparatus according to claim 5, wherein the valve block and the holding adapter comprise complementary assembly aid stop faces that are engaged with one another.

7. The hydraulic apparatus according to claim 1, wherein the control valve assembly comprises a hydraulic fluid filter.

8. The hydraulic apparatus according to claim 1, wherein the motor housing cover comprises fixing means for fixing the hydraulic apparatus to a frame.

9. The hydraulic apparatus according to claim 8, wherein the frame is a vehicle frame.

10. The hydraulic apparatus according to claim 1, wherein the pump is directly fixed on the motor housing cover's exterior.

11. The hydraulic apparatus according to claim 1, wherein the holding adapter is in the form of a spacer between the motor housing and the control valve block and protrudes transversely in relation to the motor shaft radially outwardly from the motor housing cover to ensure a cooling air flows over the motor housing cover and the control valve assembly.

12. An industrial truck comprising:

a lifting device including:

a lifting frame including:

a load suspension means designed to be raised and lowered on the lifting frame, wherein the lifting device is hydraulically controllable by a hydraulic apparatus so as to raise and lower the load suspension means on the lifting frame, and wherein the hydraulic apparatus includes:

a hydraulic pump connected to a hydraulic fluid tank;

an electric motor for driving the hydraulic pump, the electric motor including:

a motor shaft; and a motor housing cover; and a control valve assembly connected to the hydraulic pump for controlling at least one hydraulic consumer connected to the hydraulic pump through the control valve assembly and supplied by the hydraulic pump with hydraulic fluid from the hydraulic fluid tank, wherein the hydraulic pump is directly fixed on the motor housing cover, and wherein the motor housing cover includes a holding adapter on which the control valve assembly is fixed, wherein the hydraulic pump is hydraulically connected to the control valve assembly by a hydraulic fluid line external to the motor housing cover and the hydraulic pump, wherein the control valve assembly and the pump are each individually detachably and interchangeably fixed to the motor cover and wherein the hydraulic fluid line is detachably and interchangeably fixed to each of the hydraulic pump and the control valve assembly, and wherein the pump, the control valve assembly and the hydraulic fluid line are separable from one another.

13. The industrial truck according to claim 12, further comprising:

a hydraulic steering device, wherein the hydraulic apparatus is designed to hydraulically supply and control the steering device.

* * * * *